United States Patent [19]

Bando et al.

[11] Patent Number: 4,961,377

[45] Date of Patent: Oct. 9, 1990

[54] THERMAL STENCIL MASTER SHEET AND ADHESIVE THEREFOR

[75] Inventors: Masaki Bando, Tsuchiura; Kenichi Sukegawa, Inashiki; Hiromiti Yamada, Tsuchiura; Mitsutsugu Masuda, Ohmiya; Yukio Okada, Ohmiya; Mitsuyoshi Yukawa, Ohmiya; Nobuyuki Sato, Ohmiya, all of Japan

[73] Assignee: Riso Kagaku Corporation, Tokyo, Japan

[21] Appl. No.: 56,652

[22] Filed: Jun. 2, 1987

[51] Int. Cl.[5] ..... B05C 17/06

[52] U.S. Cl. ..... 101/128.21; 156/280; 156/307.5; 156/331.4; 427/143; 428/306.6; 428/317.7; 428/423.1

[58] Field of Search ..... 156/280, 307.5, 331.4; 101/128.21; 428/306.6, 317.7, 423.1; 427/143

[56] References Cited

U.S. PATENT DOCUMENTS 3,391,054 7/1968 Lewis et al. ..... 156/331.4
3,715,267 2/1973 Kubo et al. ..... 101/128.21

FOREIGN PATENT DOCUMENTS 61-116595 6/1986 Japan ..... 101/128.21

*Primary Examiner*—John J. Gallagher
*Attorney, Agent, or Firm*—Fay, Sharpe, Beall, Fagan, Minnich & McKee

[57] ABSTRACT

A thermal stencil master sheet for stencil printing has a thermoplastic synthetic resin film which is perforatable with heat and a porous substrate, which is substantially unchanged by the heat. The film is bonded to the substrate with a urethane adhesive, preferably composed mainly of a specific urethane prepolymer obtained by reacting a polyether diol with a diisocyanate so as to give an equivalent ratio of NCO/OH of at least 1.1.

4 Claims, 1 Drawing Sheet

THERMAL STENCIL MASTER SHEET AND ADHESIVE THEREFOR

BACKGROUND OF THE INVENTION

1. Field of the Invention

This invention relates to a thermal stencil master sheet for stencil printing and more particularly it relates to a thermal stencil master sheet obtained by adhering a thermoplastic synthetic resin film onto a porous substrate and an adhesive therefor.

2. Description of the Related Art

Heretofore there has been known a thermal stencil master sheet obtained by laminating a thermoplastic resin film onto a porous substrate such as a porous thin paper with an adhesive and providing a releasing agent layer on the surface of the film for preventing meltadhesion thereof onto manuscripts. Examples of the thermoplastic synthetic resin film used for such a master sheet are vinylidene chloride-vinyl chloride copolymer films, films of copolymers composed mainly of propylene, polyester films, etc. Further, examples of the porous substrate used are thin paper obtained by interlacing natural fibers or chemical fibers, sheets, non-woven fabrics, etc. Further, examples of the adhesive with which they are laminated are vinyl acetate adhesives, acrylic adhesives, rubber adhesives, etc.

As for the properties of the adhesive according to the known art, the following specific feature is required:

(i) carrying out the coating process rapidly. Further, for the properties of the adhesive layer after preparation of the base paper, (ii) the following specific features are required:

When the master sheet is laid on a manuscript and infrared lamp light or flash light is irradiated thereon to form a perforated printed image, the adhesive layer melts together with the thermoplastic resin film (i.e. the layer is superior in the so-called heat-sensitivity) and (iii) after perforation of the master sheet, when printing is repeated, the adhesive layer is not damaged by the solvent contained in the printing ink and hence is superior in the adhesion strength (i.e. superior in the durability against printing)

However, since the adhesives so far used for producing master sheets have had a large quantity of solvents and dispersing agents blended therein, a long coating rate such as at a rate of about 10–20 m/min is required, so that the production efficiency is notably reduced. Further, since the solvents used are volatile, they are liable to cause fire, air pollution, etc. Therefore, equipment has been required for recovering the solvents.

Further, vinyl acetate adhesives which have been most broadly used due to their easy handling are insufficient in their adhesion strength. For example when the same printed image is printed over two days, the stencil master sheets perforated by thermal perforation are allowed to stand on a printing machine overnight in a state where they are in contact with the printing ink during which time the vinyl acetate adhesive layer is gradually damaged, and when the image is printed after the lapse of one night, it becomes unclear; hence there is a drawback that it is impossible to achieve an objective number of sheets to be printed.

Thus the present inventors have made extensive research in order to overcome the above-mentioned drawbacks, and as a result have found that when a specified urethane prepolymer is used for the urethane adhesives which have so far been regarded as difficult to use, the coating rate becomes as high as 5 to 10 times that of the conventional process. The adhesive layer after curing exhibits a good perforation (heat-sensitivity) through conventional thermal perforation means such as infrared lamp, flash lamp, etc.; and the adhesive layer is not damaged by the solvent contained in a printing ink. The adhesive is also superior in adhesion strength so that even when printing is carried out over two days or longer a printable stencil master sheet can be obtained.

Based on the above findings, the present invention has been completed.

SUMMARY OF THE INVENTION

The object of the present invention resides in forming a thermal stencil master sheet obtained by adhering a thermoplastic synthetic resin film which can be perforated with heat, onto a porous substrate which is substantially unchanged by the heat, with a urethane adhesive preferably consisting essentially of a urethane prepolymer obtained by reacting a polyether diol with a diisocyanate so as to give an equivalent ratio of NCO/OH of 1.1 or more.

DETAILED DESCRIPTION OF PREFERRED EMBODIMENTS

Figure 1:
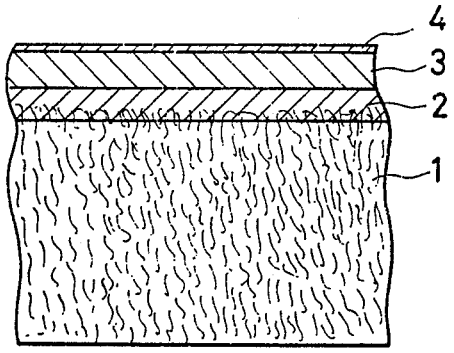
FIG. 1 shows an explanatory view typically illustrating the structure of the thermal stencil master sheet

The above-mentioned urethane adhesive is preferred to consist essentially of a urethane prepolymer obtained by reacting a polyether diol with a diisocyanate so as to give an equivalent ratio of NCO/OH of 1.1 or more.

The amount of the urethane adhesive coated in the master sheet of the present invention is preferred to be in the range of 0.3 to 2.5 g/m$^2$, the viscosity at 25° C. of the adhesive is preferred to be 10,000 cps or higher. At the time of adhesion, the thermoplastic resin film and the porous substrate are subjected to contact bonding and curing, preferably under a pressure of 2 Kg/m$^2$ or higher.

Particularly preferred adhesives are those obtained by reacting a diisocyanate with a polyether diol having a number average molecular weight of 400 to 2,000 in an equivalent ratio of NCO/OH of 1.5 to 2.0, composed mainly of a urethane prepolymer and having a flow temperature after curing, of 150° to 260° C.

Examples of the diisocyanate used in the above adhesives are aliphatic or alicyclic diisocyanates such as hexamethylene diisocyanate (HMDI), 2,4-diisocyanate-1-methylcyclohexane, 2,6-diisocyanate-1-methylcyclohexane, diisocyanatecyclobutane, tetramethylene diisocyanate, o-, m- and p-xylylene diisocyanates (XDI), dicyclohexylmethane diisocyanate, dimethyldicyclohexylmethane diisocyanate, hexahydrometaxylidene diisocyanate (HXDI) and lysine diisocyanate alkyl esters (the alkyl moiety of which is preferred to have 1 to 6 carbon atoms); aromatic diisocyanates such as toluylene-2,4-diisocyanate (TDI), toluylene-2,6-diisocyanate, diphenylmethane-4,4'-diisocyanate (MDI), 3-methyldiphenylmethane-4,4'-diisocyanate, m- and p-phenylene diisocyanates, chlorophenylene-2,4-diisocyanate, naphthalene-1,5-diisocyanate, diphenyl-4,4'-diisocyanate, 3,3'-dimethyldiphenyl-1,3,5-triisopropylbenzene-2,4-diisocyanate, diphenyl ether diisocyanate, etc.; and mixture of the foregoing.

Examples of the polyether diol used in the present invention are polyethylene glycol (PEG), polypropylene glycol (PG), polyoxyethylene-polypropylene block copolymer, polytetramethylene glycol, polytetramethylethylene glycol, polybutadiene glycol, hydrogenated polybutadiene glycol, bisphenol A-based diol, acrylpolyether diol, etc.

As the polyether diols, those having a number average molecular weight of 400–2,000, preferably 800–1,000 may be used. If the weight is less than 400, the viscosity of the resulting adhesives at the time of coating is too high to make their handling difficult and also the pot life is shortened so that their handling on the coating machine is difficult. If the molecular weight exceeds 2,000, the perforatability of the adhesive layer after production of the master sheet and the endurability to printing are reduced.

As to the isocyanate and polyether diol, an urethane prepolymer obtained by reacting these in an equivalent ratio of NCO/OH of 1.5–2.0 may be used. If the ratio of NCO/OH$<$1.5, the flow temperature of the resulting urethane prepolymer after its curing is liable to be lower than 150° C. and also the adhesion is reduced. Further, the viscosity of the urethane prepolymer has a high viscosity so that the operation efficiency is inferior. If NCO/OH$>$2.0, the isocyanate monomer remains, which is hygienically undesirable.

As to the adhesive for the master sheet of the present invention, since the isocyanate group contained in the adhesive is reacted with a chain-extending agent such as water, glycols, diamines, etc., followed by curing the reaction product in the form of a chain molecule, it is necessary that both the ends of the prepolymer have NCO group, and hence one molecule thereof has at least two NCO groups.

Preparation of the adhesive for the master sheet of the present invention may be carried out either according to a stepwise preparation process or according to a process of feeding the materials together. For example, according to the latter process, a diisocyanate and a polyether diol are fed together in an equivalent ratio of NCO/OH of 1.5–2.0, and if necessary, a solvent and a catalyst such as phosphoric acid, dibutyltin dilaurate, etc. are at the same time fed, followed by reacting the above materials with stirring at 50° to 120° C. in a closed vessel or in a nitrogen gas current to complete the urethaneformation reaction. Thereafter, if necessary, the solvent is distilled off to obtain the reaction product (prepolymer) According to the stepwise preparation process, the diisocyanate may be reacted in advance so that a definite equal quantity of isocyanate group may remain, followed by feeding a definite proportion of a polyether diol so that it may be stoichiometerically reacted, to similarly complete the urethane formation reaction.

Curing of the thus obtained prepolymer has no particular limitation but includes a process of adding water (steam), glycol, diamine or the like, and with process of irradiating a light energy such as ultraviolet ray, for example.

The flow temperature of the adhesive for the master sheet of the present invention after the reaction and curing is in the range of 150° to 260° C., preferably 150° to 240° C. If it exceeds 260° C., thermal perforation at the time of making a stencil master sheet is not completely carried out so that it is often impossible to obtain a good printed image, while if it is lower than 150° C., adhesion is decreased.

The flow temperature may be controlled by adding an agent for lowering the flow temperature to the above prepolymer. Examples of such agent for lowering the flow temperature are thermoplastic resins which do not contribute to the urethane reaction such as wax, rosin, rosin ester, petroleum resin, an agent for inhibiting thermoplastic resin urethane branching reaction (e.g. butadienesulfone, p-toluenesulfonic acid, phosphoric acid esters, boric acid esters, etc.).

The amount of the adhesive coated for the master sheet of the present invention is preferably in the range of 0.3–2.5 g/m$^2$, more preferably 0.5-1.5 g/m$^2$. If the amount is less than 0.3 g/m$^2$, the adhesive force is reduced so that the film is easily peeled off from the porous substrate, while if it exceeds 2.5 g/m$^2$, although the adhesive layer becomes thinner through contact bonding, the heat-sensitive perforation is not sufficiently carried out due to its too large amount to make it impossible to obtain a good printed image.

The viscosity of the adhesive (prepolymer) for the master sheet of the present invention is preferably 10,000 cps or higher, more preferably 50,000 cps or higher in the aspect of productivity. It requires usually 24 to 48 hours at room temperature for the thermoplastic resin film adhered onto the porous substrate to be completely cured. If the viscosity is too low, the adhesive may often transfer onto the surface of the film of the wound-up master sheet before it has been cured, or when the wound-up roll is stood up and stored, the adhesive may often flow down to cause unevenness of the adhesive layer. As to the adhesive for the thermal stencil sheet of the present invention, it is usually unnecessary to blend it with a solvent, but if necessary, solvent may be added in a small amount.

A sufficient thermoplastic resin film to be adhered onto the porous substrate usable for the thermal stencil master that is perforatable includes, particularly a highly oriented or stretched film such as films of polyesters, polyvinyl chloride, vinylidene chloride-vinyl chloride copolymers, copolymers composed mainly of propylene, and among these, polyester (PET) film and polyvinylidene chloride film are preferable.

Further, the porous substrate may be of a porous material which is stable and not perforated by thermal perforation, but passes ink at the time of printing. Preferred examples of such substrates are thin papers of Manila hemp, polyester fibers, etc., non-woven fabrics, screen plain gauze of polyester fibers, silk, etc.

When the thermoplastic resin film is bonded to the porous substrate with a urethane adhesive, contact bonding under a pressure of 2 Kg/cm$^2$ or higher is preferred. By employing such a pressure of 2 Kg/cm$^2$ or higher, the porous substrate is fully embedded in the adhesive layer to improve the perforatability and adhesion at the time of making a stencil master sheet. As to this pressure operation, any processes which can pressurize the adhesion surface uniformly, may be employed and the process can be easily carried out by means of press rolls or the like.

An embodiment of the process for producing the master sheet of the present invention will be described. A urethane prepolymer prepared as above, if necessary after adding a certain quantity of a solvent, is uniformly coated on a thermoplastic resin film provided on a hot plate having a flat smooth surface by means of a bar, followed by volatizing the solvent, overlaying the porous substrate upon the adhesive-coated film, heating the hot plate to 60° C. or higher, applying a metal roll to the porous substrate from thereabove, applying a pressure of 2 Kg/cm$^2$ or higher, allowing the resulting material to stand at room temperature for 24 to 48 hours to cure the adhesive by the reaction thereof with the moisture in air, thereafter peeling off the resulting master sheet from the surface of the hot plate and coating a releasing agent onto the film to obtain the master sheet of the present invention. The obtained thermal stencil sheet for heat-sensitive perforated plate printing is in the form wherein the porous substrate 1 is embedded in the adhesive layer 2, and the thermoplastic synthetic resin film is adhered thereto, and further the releasing agent layer 4 is adhered thereonto, as shown in FIG. 1. Since a structure in which a portion of the porous substrate is embedded in the adhesive layer 2 as shown in FIG. 1 is formed, the adhesion is improved and also the endurability to printing is improved in cooperation with the durability of the urethane adhesive itself such as resistance to solvent, and at the same time since the adhesive layer is thinly constituted due to the pressure applied at the time of making a master sheet, the perforatability at the time of thermal perforation is improved and it is possible to obtain a good resolving power.

The present invention will be described in more detail by way of Examples and Comparative examples. In these examples, parts means parts by weight.

EXAMPLE 1

Diphenylmethane-4,4'-diisocyanate (47.5 parts), a polypropylene glycol having a number average molecular weight of 1,000 (100 parts) and phosphoric acid as a catalyst (0.2 part) were introduced into a reactor so as to give an equivalent ratio of NCO/OH of 1.9, followed by reacting these in a nitrogen gas atmosphere at 70° C. for 4 hours to obtain a urethane prepolymer to constitute the adhesive for the master sheet of the present invention. This adhesive had a viscosity of 80,000 cps at 25° C. and had a flow temperature of 208° C. after moisture-curing. In addition, the flow temperature refers to a value measured by means of a flow tester having an orifice diameter of 1.0 mm$\phi$ and a length of 1.0 mm under a load of 20 Kg and at a temperatureraising rate of 6° C./min.

The obtained urethane prepolymer adhesive was heated to 100° C. and fed to coating rolls of a non-solvent type laminator heated to 100° C., and with this adhesive, a polyester film of 2$\mu$ thickness was laminated onto a porous substrate of a thin paper of Manila hemp (8.5 g/m$^2$). At the time of the lamination, the pressure between the rolls was 5 Kg/cm$^2$ and the amount of the adhesive coated was 0.8 g/m$^2$. In addition, in this process, occurrence of decomposed material or vaporized material was not observed at all. By using thus prepared master sheet, thermal perforation was carried out in a stencil duplicator (RISOGRAPH FX 7200, Trademark of a product manufactured by Riso Kagaku Corporation) at the position of a graduation of 3, and stencil printing was performed using said stencil master sheet in a stencil printing device (RISOGRAPH AP 7200, Trademark of a product manufactured by Riso Kagaku Corporation) to obtain a good printed image.

Further, the following items were measured and the results are shown in Table 1.

(i) Number of sheets endurable to printing:

An ink is adhered onto a stencil master sheet prepared using a stencil duplicator (RISOGRAPH FX 7200) at the position of a graduation of 3, followed by allowing the resulting sheet to stand for 12 hours, and then carrying out printing using a printing machine (RISOGRAPH AP 7200). The number of printed sheets obtained when the first lateral straight line of 0.15 mm in width has reached 0.3 mm in width, is referred to as the number of sheets endurable to printing.

(ii) Percentage perforation (%):

This refers to the proportion of the portion perforated when all over printed portion of the master sheet was made thermal perforation using a stencil duplicator (RISOGRAPH FX 7200) at the position of a graduation of 3.

EXAMPLE 2

Diphenylmethane-4,4'-diisocyanate (MDI) (25 parts), a polypropylene glycol having a number average molecular weight of 2,000 (64 parts) to give a polyether diol having a number average molecular weight of 1,470 and a bisphenol A-propyleneoxide adduct (Adeka polyether BPX-33, tradename of a product manufactured by Asahi Denka K. K.) (11 parts) were fed into a vessel so as to give an equivalent ratio of NCO/OH of 1.9, followed by reacting these in a nitrogen gas atmosphere at 70° C. for 4 hours to obtain a urethane prepolymer to constitute the adhesive for the master sheet of the present invention.

This adhesive had a viscosity of 130,000 cps at 25° C. and the flow temperature after moisture-curing was 225° C.

Thereafter a stencil master sheet was prepared in the same manner as in Example 1 and thermal perforation and printing were carried out in the same manner as in Example 1 to obtain a good printed image due to the superior heat-sensitivity of the master sheet.

EXAMPLE 3

Toluylene-2,4-diisocyanate (TDI) (12.5 parts), diphenylmethane-4,4'-diisocyanate (MDI) (12.5 parts), a polyethylene glycol having a number average molecular weight of 1,000 (37.5 parts) and phosphoric acid (0.1 part) were introduced into a vessel so as to give an equivalent ratio of NCO/OH of 1.6, followed by heating these in a nitrogen gas atmosphere at 70° C. for 6 hours to obtain an urethane prepolymer to constitute the adhesive for the master sheet of the present invention. The adhesive had a viscosity at 25° C. of 140,000 cps and the flow temperature after moisture-curing was 182° C.

Thereafter a stencil master sheet was prepared in the same manner as in Example 1 and thermal perforation and printing were carried out in the same manner as in Example 1 to obtain a good printed image due to the superior heat-sensitivity of the master sheet.

EXAMPLE 4

Hexamethylene diisocyanate (23.1 parts), a polytetramethylene ether glycol having a number average molecular weight of 1,000 (76.3 parts) and dibutyltin dilaurate as a catalyst (0.01 part) were introduced into a vessel so as to give an equivalent ratio of NCO/OH of 1.8, followed by heating these in a nitrogen gas atmosphere at 80° C. for 6 hours to obtain a urethane prepolymer to constitute the adhesive for the master sheet of the present invention.

This adhesive had a viscosity of 60,000 cps at 25° C. and the flow temperature after moisture-curing was 196° C.

Thereafter a stencil master sheet was prepared in the same manner as in Example 1 and thermal perforation and printing were carried out in the same manner as in Example 1 to obtain a good printed image due to the superior heat-sensitivity of the master sheet.

EXAMPLE 5

Toluylene-2,4-diisocyanate (TDI) (60 parts), diphenylmethane-4,4'-diisocyanate (MDI) (70 parts), a polypropylene glycol having a number average molecular weight of 700 (280 parts) and a rosin ester (Ester Gum HD, tradename of a product manufactured by Arakawa Kagaku K. K.) (100 parts) were introduced into a reactor so as to give an equivalent ratio of NCO/HO of 1.55, followed by reacting these in a nitrogen gas atmosphere at 80° C. for 3 hours to obtain an adhesive for the master sheet of the present invention composed mainly of a urethane prepolymer.

This adhesive had a viscosity of 340,000 cps at 25° C. and the flow temperature after moisture-curing was 185° C.

Thereafter a stencil master sheet was prepared in the same manner as in Example 1 and thermal perforation and printing were carried out in the same manner as in Example 1 to obtain a good printed image due to the superior heat-sensitivity of the master sheet.

COMPARATIVE EXAMPLE 1

Diphenylmethane-4,4'-diisocyanate (32.5 parts) and a polypropylene glycol having a number average molecular weight of 1,000 (100 parts) were introduced into a reactor so as to give an equivalent ratio of NCO/OH of 1.3, followed by reacting these in a nitrogen gas atmosphere at 70° C. for 3 hours to obtain a urethane prepolymer adhesive.

This adhesive had a viscosity of 28,000 cps at 25° C. and the flow temperature after moisture-curing was 142° C.

Thereafter a stencil master sheet was prepared in the same manner as in Example 1 and thermal perforation and printing were carried out in the same manner as in Example 1. As a result, while the master sheet had a superior heat-sensitivity, the adhesive layer was easily damaged by printing ink and the number of sheets endurable to printing was only 20 sheets.

COMPARATIVE EXAMPLE 2

Diphenylmethane-4,4'-diisocyanate (4 parts) and a polypropylene glyocl having a number average molecular weight of 360 (360 parts) were introduced into a reactor so as to give an equivalent ratio of NCO/OH of 1.8, followed by heating these in a nitrogen gas atmosphere at 70° C. for 3 hours to obtain a urethane prepolymer adhesive.

This adhesive had a viscosity of 210,000 cps at 25° C. and the flow temperature after moisture-curing was 236° C.

Thereafter a stencil master sheet was prepared in the same manner as in Example 1 and thermal perforation and printing were carried out in the same manner as in Example 1. As a result, while the master sheet had a superior heat-sensitivity, the adhesive layer was easily damaged by printing ink and the number of sheets endurable to printing was only 300 sheets.

COMPARATIVE EXAMPLE 3

Diphenylmethane-4,4'-diisocyanate (5 parts) and a polypropylene glycol having a number average molecular weight of 2,500 (2,500 parts) were introduced into a reactor so as to give an equivalent ratio of NCO/OH of 1.9, followed by reacting these in a nitrogen atmosphere at 80° C. for 4 hours to obtain a urethane prepolymer adhesive.

This adhesive had a viscosity of 45,000 cps at 25° C. and the flow temperature after moisture-curing was 180° C.

Thereafter a stencil master sheet was prepared in the same manner as in Example 1 and thermal perforation and printing were carried out in the same manner as in Example 1. As a result, since the adhesive layer of the master sheet was inferior in heat-sensitivity, the heat-sensitive part was not sufficiently perforated; hence printing was impossible.

COMPARATIVE EXAMPLE 4

A vinyl acetate copolymer having a number average molecular weight of 600 (15 parts) and a phenolic resin (2 parts) were dissolved in methanol (83 parts) to obtain an adhesive for the master sheet.

Using this adhesive, the porous paper and the polyester film used in Example 1 were laminated together according to wet lamination process to prepare a master sheet, and with this sheet, thermal perforation was carried out in the same manner as in Example 1, but a very long time was required for preparing a stencil master sheet.

TABLE 1

| | Number of sheets endurable to printing | Percentage perforation (%) | Coating process rate (m/min.) |
|---|---|---|---|
| Example 1 | 6500 | 56 | 100 |
| Example 2 | 5000 | 46 | 120 |
| Example 3 | 4800 | 53 | 100 |
| Example 4 | 4000 | 51 | 150 |
| Example 5 | 4000 | 49 | 100 |
| Comparative example 1 | 20 | 31 | 100 |
| Comparative example 2 | 300 | 23 | 100 |
| Comparative example 3 | — | 12 | 100 |
| Comparative example 4 | 2000 | 51 | 15 |

As seen from the results of Table 1, the coating process by the use of the adhesive for the master sheet may be carried out according to various ways, but in particular since it is possible to carry out coating by means of a non-solvent type laminator, the coating process rate is 100 to 200 m/min. and 5 to 10 times those in the case of conventional products; hence the productivity is very high.

Further, since the specific adhesive layer after coating is superior in adhesion strength and resistant to solvent, the master sheet wherein the adhesive is used is superior in perforatability (heat-sensitivity) and resolving power even at the time of making the stencil master sheet and printing. Further, even when printing is carried out over two days or longer, it is not damaged by printing ink and is superior in the endurability to printing.

What we claim is:

1. A thermal stencil master sheet for stencil printing, comprising a thermoplastic synthetic resin film that is perforatable with heat, and a porous substrate that is substantially unchanged by the heat, said film being bonded to a surface of said porous substrate with a urethane adhesive consisting essentially of a urethane prepolymer obtained by reacting a polyether diol with a diisocyanate so as to give an equivalent ratio of NCO-/OH of at least 1.1

2. A thermal stencil master sheet according to claim 1 wherein said polyether diol has a number average molecular weight of 800 to 1,000.

3. A thermal stencil master sheet for stencil printing, comprising a thermoplastic synthetic resin film that is perforatable with heat, and a porous substrate that is substantially unchanged by the heat, said film being bonded to a surface of said porous substrate with a urethane adhesive wherein said urethane adhesive consists essentially of a urethane prepolymer obtained by reacting a polyether diol having a number average molecular weight of 400 to 2,000 with a diisocyanate so as to give an equivalent ratio of NCO/OH of 1.5 to 2.0 and has a flow temperature after curing thereof of 150°-260° C.

4. A thermal stencil master sheet according to claim 1 wherein the quantity of said urethane adhesive coated on the surface of said porous substrate is in the range of 0.3 to 2.5 g/m$^2$, the viscosity at 25° C. of said urethane adhesive is at least 10,000 cps and the adhesion is carried out by contact bonding and curing under a pressure of at least 2 Kg/cm$^2$.

* * * * *